US006439431B1

(12) United States Patent
Breault et al.

(10) Patent No.: US 6,439,431 B1
(45) Date of Patent: Aug. 27, 2002

(54) SINGLE STROKE FLUID DISPENSE SYSTEM

(75) Inventors: John P. Breault, New Britain; Martin C. Cosgrove, Harwinton, both of CT (US)

(73) Assignee: Loctite Corporation, Rocky Hill, CT (US)

( * ) Notice: Subject to any disclaimer, the term of this patent is extended or adjusted under 35 U.S.C. 154(b) by 0 days.

(21) Appl. No.: 09/719,547

(22) PCT Filed: Aug. 29, 1999

(86) PCT No.: PCT/US99/19587

§ 371 (c)(1),
(2), (4) Date: Dec. 22, 2000

(87) PCT Pub. No.: WO00/10886

PCT Pub. Date: Mar. 2, 2000

Related U.S. Application Data

(60) Provisional application No. 60/097,584, filed on Aug. 24, 1998.

(51) Int. Cl.[7] ..... B65D 35/56

(52) U.S. Cl. ..... 222/105; 222/82; 222/327

(58) Field of Search ..... 222/82, 95, 105, 222/137, 325, 326, 327, 386, 389, 541.3, 541.4

(56) References Cited

U.S. PATENT DOCUMENTS 3,753,641 A * 8/1973 Turner et al. ..... 425/450
5,320,250 A * 6/1994 La et al. ..... 222/1
5,826,409 A * 10/1998 Slepicka et al. ..... 53/492

* cited by examiner

*Primary Examiner*—Henry C. Yuen
*Assistant Examiner*—Melvin A. Cartagena
(74) *Attorney, Agent, or Firm*—Steven C. Bauman

(57) ABSTRACT

A single stroke fluid dispense system, including a dispense member having a dispense end defining a dispense end opening and a container well communicating with the dispense end opening for receiving a fluid to be dispensed. A closure cap is supported over the dispense end opening of the dispense member and further defines a fluid passageway therethrough in fluid communication with the container well. A compression assembly for forcing the fluid through the fluid passageway of the closure cap is also provided. A sealing piston assembly maintains the closure cap in sealing engagement with the dispense member. The closure cap may further defined a burst port at one end of the fluid passageway facing the container well which is especially useful for dispensing fluid from a flexible rupturable container. The compression assembly maintains fluid integrity between the container and the closure cap about the rupture port throughout dispensement so as to thwart fluid from leaking into the container well. The container also seals the interface between the dispense member and the closure cap during dispensement of the fluid to be dispensed through the closure cap. The compression assembly further augments the sealing force between the dispense member and the closure cap by forcing the container against the internal dispense cylinder wall to further carry the dispense cylinder against the closure cap.

20 Claims, 10 Drawing Sheets

SINGLE STROKE FLUID DISPENSE SYSTEM

This application claims benefit of Provisional Application Ser. No. 60/097,584 filed Aug. 24, 1998.

FIELD OF THE INVENTION

The present invention is directed to the field of fluid dispense systems. More specifically, the present invention is directed to a single-stroke dispense system for a collapsible dispense container which both provides the fluid to be dispensed and seals the dispense system during dispensement.

BACKGROUND OF THE INVENTION

The art has seen a variety of dispense systems for delivering a fluid from a storage container to a work surface. Such dispense systems are employed to dispense many types of fluids of varying viscosities. Dispense systems for delivering fluids such as anaerobic adhesives and sealants from a storage container to a work surface may be adversely affected by the curing of the adhesive or sealant while still within the delivery system. As anaerobic adhesives and sealants cure, or harden, in the absence of air, their presence within a fluid delivery system over a period of time can result in their curing within a delivery line between the storage container of the fluid and the dispense port of the delivery system. The problems associated with premature or undesired curing within a delivery system is exacerbated by the use of components, such as valves or conduit, having metallic fluid-contacting components, which require regular maintenance or cleaning. It is well-known in the art to therefore provide delivery systems for anaerobic adhesives and sealants with valve surfaces fabricated from a non-stick surface such as TEFLON® or DELRIN®. It is also well-known in the art to provide fluid conduit, or tubes, formed from plastics such as TEFLON®, polyethylene, or nylon, which are non-reactive with anaerobic fluids and which are permeable to oxygen so as to supply oxygen to the anaerobic fluid. Employing these materials in an anaerobic fluid delivery system thereby thwarts or delays the fluid from fouling the delivery lines.

Some fluid delivery systems entail reciprocating components having finely designed clearances therebetween for providing mechanical pumping action to move the fluid from a storage container to a dispense nozzle. Small amounts of fluid may become entrapped in these small clearances during the course of normal operation. Such intimate contact between the anaerobic fluid and the dispense system components can, upon the curing of the fluid within the dispense system, disrupt the smooth motion between the components and require time consuming repairs or costly replacement of the reciprocating components. Furthermore, from a dispense operation standpoint, the reciprocating action of these dispense systems produces intermittent dispensement of the fluid at the dispense nozzle. The intermittent dispensement, even when minimized by a short stroke or high frequency piston, provides a non-uniform bead of dispensed material. In many applications, it is desirable to provide as uniform bead of adhesive or sealant at the interface between mating surfaces as possible. It is therefore desirable to provide a single-stroke dispense system for dispensing all of the anaerobic fluid contained within a storage container so as to provide a uniform dispensed bead of fluid and to minimize the exposure of the fluid to any intimate spaces within the dispense system.

The unintended presence of anaerobic fluids within a delivery system is exacerbated by the opening of the fluid storage container prior to placing the container in communication with the dispense system. The problem may also be exacerbated when the storage container is punctured open when initially closing the container within the dispense system. These pre-opened containers increase the likelihood of unintentional fluid spillage or travel within the dispense system, and require increased operator attention and maintenance to limit the risk of the fluid curing within intimate spaces.

It is also common for dispense systems to employ sealing means such as an elastomeric gasket between a storage vessel container body and a storage vessel closure cap. Elastomeric gaskets are susceptible, however, to being contaminated by the material flowing therepast which can result in gasket failure. Gasket deterioration or failure may result in time-consuming and costly maintenance or repair operations. When the gasket is seated within a groove or channel, retrieval of the gasket and cleansing of the channel can be especially time-consuming and difficult. In view of these risks, it is desirable to provide a dispense system for an anaerobic fluid which minimizes or eliminates the need for elastomeric gasket components which may experience long-term exposure to the fluid. It is also desirable to provide a storage container for an aerobic fluid that may be loaded into a dispense system in a sealed condition and that will remain sealed until dispensement is to begin. Furthermore, once dispensement begins, it is desirable for the storage container for the anaerobic fluid to also provide a single-use gasketing means which seals the dispense system throughout dispensement of the fluid from the container.

Certain dispensers of the prior art have utilized a collapsible, rupturable container or bag of fluid within a manually operated dispenser similar to a single stroke air pump. The container, having about 300 milliliters of adhesive or silicone, is placed in a cylindrical housing having a dispense port at one end and a slidable piston which compresses the container about the dispense port. The pressure applied to the container causes the container material to rupture at the dispense port so that continued sliding of the manual piston towards the dispense port expresses the fluid therethrough. Such a manually-operated dispenser is ill-suited to industrial applications due to the small amounts of fluid contained in each container and the recurring need to swap out successive containers in a clean and efficient manner. Furthermore, because the dispense force of the manually-operated piston may be relaxed during intermittent dispensement of the fluid, the fluid is able to back-travel towards the container and leak between the container and the dispenser cavity adjacent the dispense port. Subsequently, removing the container from the cavity of these dispensers is complicated by the entrapped fluid which must be cleared away prior to insertion of subsequent containers or, depending on the fluid, prior to its curing.

For industrial applications, dispense systems of the prior art utilize pressure vessels for storing relatively large quantities of the fluid and for dispensing the fluid pressurizing the pressure vessel. These pressure vessels are typically sealed by mechanical securement means which an operator must properly position and secure so as to maintain the integrity of the pressure vessel when pressurized. The mechanical securement means may include a cap to be threaded over the open end of the pressure vessel or may include, for example, a plurality of threaded clamps which must be individually tightened to abuttingly secure the cap to the pressure vessel. Such mechanical securement means require high manual effort by the operator to ensure that each clamp or threaded fastener is properly torqued so as to sufficiently seal the pressure vessel. An additional drawback to these securement devices is that each may still be unfastened even though the pressure vessel is still pressurized. It would therefore be desirable to provide a sealing system for a pressure vessel that does not require high operator involvement to operate and that provides a fail-safe feature in that the sealing system will prevent pressurized vessel from being opened.

It is therefore desirable to provide a dispense system for a collapsible rupturable container of fluid suitable in industrial settings to dispense large quantities of stored fluid and which provides a clean and efficient swapping out of successive containers of fluid.

SUMMARY OF THE INVENTION

The present invention provides a single stroke fluid dispense system, including a dispense member having a dispense end defining a dispense end opening and a container well communicating with the dispense end opening for receiving a fluid to be dispensed. A closure cap is supported over the dispense end opening of the dispense member and further defines a fluid passageway therethrough in fluid communication with the container well. A compression assembly for forcing the fluid through the fluid passageway of the closure cap is also provided. A sealing piston assembly maintains the closure cap in sealing engagement with the dispense member.

The dispense system may include a cap blocking assembly including first and second elongate guide rods extending to either side of the dispense member. Each guide rod includes a first end adjacent the dispense opening of the dispense member. An elongate locking bar is extendable between the first ends of the guide rods across the closure cap opposite the dispense member. A first plate is affixed to the dispense member and supports thereon a plurality of sealing pistons. Each sealing piston includes a sealing piston cylinder and a sealing piston rod extendable and retractable from the sealing piston cylinder. The sealing piston rods are operable against the first and second guide rods to compress the closure cap between the dispense member and the locking bar. A second plate may be fixed with respect to the first and second guide rods for the sealing piston rods to operate against. The second plate may alternatively be affixed to the first guide rod. The second plate defines a centrally-located dispense cylinder passageway therethrough for accommodating the dispense member.

It is contemplated that the dispense member may be formed by an elongate hollow dispense cylinder having an actuation end opposite the dispense end, and an internal cylindrical wall defining an elongate cylindrical passageway therethrough. A hollow internal bushing may be provided to extend into the working end of the dispense cylinder and while being fixed with respect to the first and second guide rods. The internal bushing defines a bushing passageway through which the compression assembly extends.

In place of the second plate, the sealing piston assembly may further include an elongate locking lever pivotally mounted for each sealing piston rod. Each the locking lever includes a first end engaging one the sealing piston rods and a second opposite end engaging one of the first and second guide rods, such that extension of the piston rods against the first ends of the locking levers raises the dispense member against the closure cap.

The locking bar may include a first end pivotally connected to the first guide rod and a second end defining a transversely-extending notch for receiving the second guide rod. Pivoting the locking bar away from the second guide rod allows the closure cap to be removed from its position overlying the dispense opening of the dispense member. Pivoting the locking bar over the closure cap prevents removal of the closure cap from the dispense member.

The compression assembly typically includes an internal piston slidable within the cylindrical passageway of the dispense cylinder. The internal piston supports a piston seal for slidably sealingly engaging the cylindrical wall of the dispense cylinder. A ram apparatus having a main dispense cylinder supports an elongate dispense piston rod which is extendable and retractable from the main dispense cylinder. The dispense piston rod is coupled to the internal piston to extend the internal piston towards the dispense cap upon extension of the dispense piston rod from the main dispense cylinder. The piston seal may be formed of polytretraflouroethylene for ease of dispensing certain adhesives and sealants.

The closure cap may further define a burst port at one end of the fluid passageway facing the container well. The burst port is especially useful for dispensing fluid from a flexible rupturable container. The compression assembly maintains fluid integrity between the container and the closure cap about the rupture port throughout dispensement so as to thwart fluid from leaking into the container well. The container also seals the interface between the dispense member and the closure cap during dispensement of the fluid to be dispensed through the closure cap. As the dispense member is only supported at the dispense end, the compression assembly augments the sealing force between the dispense member and the closure cap by additionally forcing the container against the internal dispense cylinder wall to further carry the dispense cylinder against the closure cap. The present invention is therefore able to augment the sealing force between the dispense member and the closure cap in proportion to the internal pressure generated at the container of fluid.

The dispense member and closure cap of the present invention may therefore include abutting planar annular rims without the need for supporting a sealing or gasket member therebetween. The container for the fluid seals the interface between the dispense member and the closure cap in container-tight engagement, that is, the container will not rupture at the interface of the dispense member and closure cap so that proper dispensement through the burst port is assured. Proper alignment between the dispense member and closure cap may be enhanced by providing a pair of alignment bores and cooperating positioning pins extending between the abutting annular rims of the closure cap and the dispense member.

In one embodiment, the present invention provides a single stroke fluid dispense system for dispensing the contents of a collapsible rupturable plastic container of fluid in which the system includes an elongate hollow dispense cylinder having a dispense end, an actuation end opposite the dispense end, and an internal cylindrical wall defining an elongate cylindrical passage. A closure cap is supported over the dispense end of the dispense cylinder. The closure cap and internal cylindrical wall define a container well for receiving the container of fluid therein. The closure cap further includes a rupture port defining one end of a fluid passageway extending through the closure cap in fluid communication with the container well. An internal piston is mounted for sliding engagement with the internal cylindrical wall and is extendable through the container well. A ram apparatus is operable against the internal piston to move the internal piston towards and away from the closure cap. The dispense system also includes a sealing piston assembly to carry the dispense cylinder against the closure cap in sealing registry over the dispense opening of the dispense member and for freely supporting the working end of the dispense cylinder with respect to the ram apparatus. The ram apparatus also forces the container against the internal dispense cylinder wall to further carry the dispense cylinder against the closure cap. The fluid pressure generated by the ram apparatus within the container well also maintains the fluid integrity between the container and the closure cap about the rupture port throughout dispensement of the fluid. The container itself also seals the interface between the dispense cylinder and the closure cap to maintain the fluid integrity there.

Methods of dispensing fluids are also taught. The present invention will be more readily appreciated in a reading of the "Detailed Description of the Invention" with reference to the following drawings.

DETAILED DESCRIPTION OF THE PREFERRED EMBODIMENT

Figure 1:
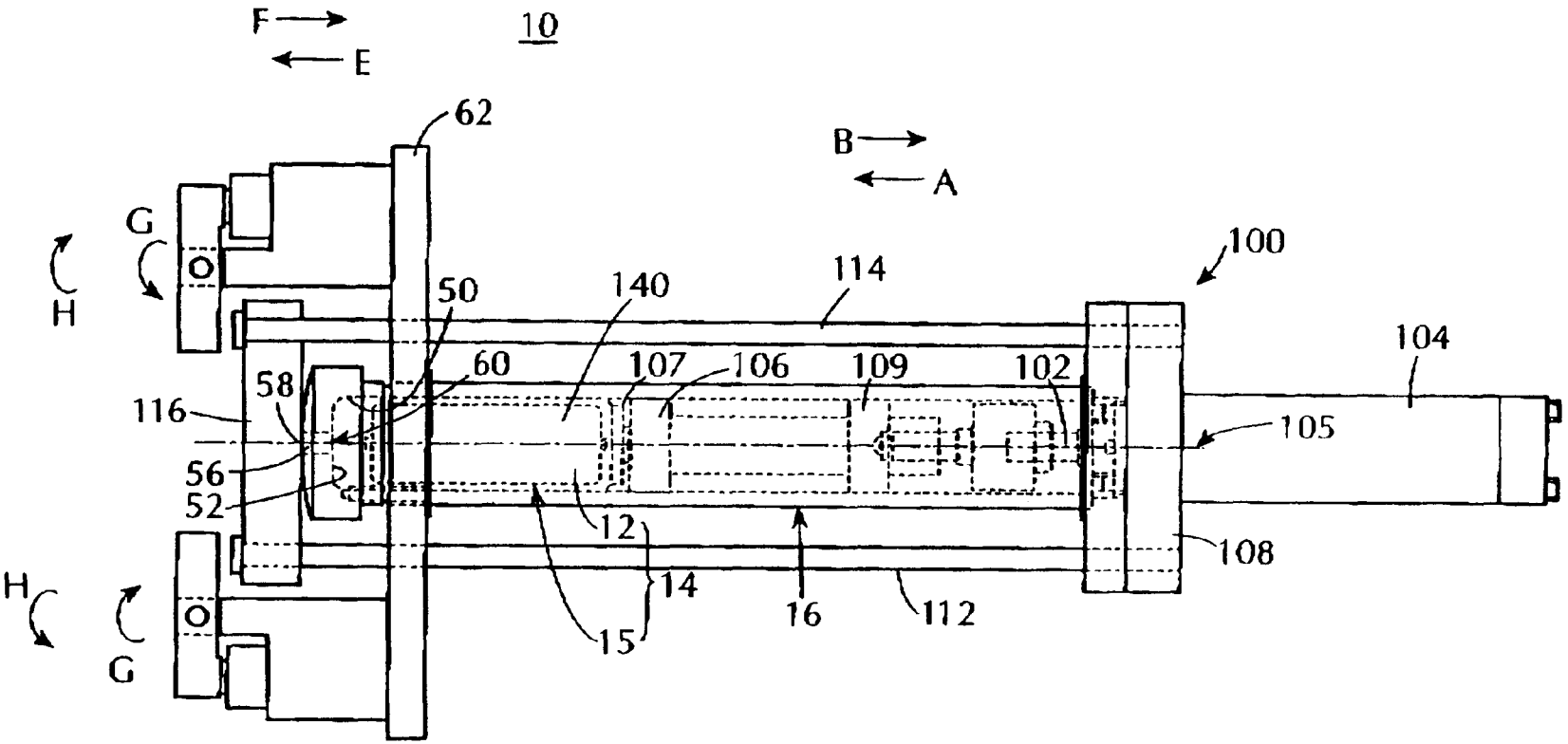
FIG. 1 is a schematic representation of a dispense system of the present invention prior to energizing the sealing piston assembly.

Referring to FIG. 1, the present invention provides a single stroke dispense system 10 for dispensing a fluid 12 from a sealed, flexible cylindrical container 14. Except where otherwise indicated, dispense system 10 is formed of a suitable metal, however those skilled in the art will appreciate that certain components may be fabricated from alternate non-metallic materials. Container 14 may take the form of a rupturable chubb pack bag 15 provided in an elongate cylindrical form with opposed closed ends for containing fluid 12 therein. Chubb pack bag 15 is desirably formed of a plastic material suitable for use with an anaerobic adhesive or sealant, such as polyethylene. Chubb pack bag 15, as well as the generic container 14, may additionally be formed of a two-ply construction of polyethylene and polypropylene which is both flexible and rupturable under pressure. Desirably, container 14 accommodates about 1 liter of dispensable fluid.

Figure 3A:
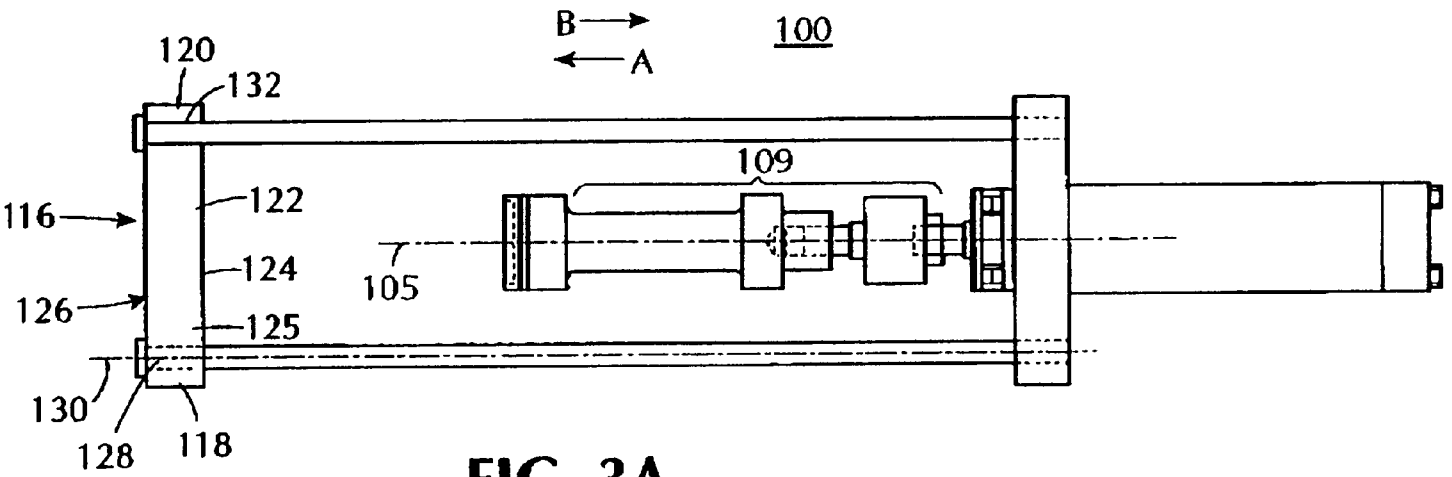
FIGS. 3*a–b* depict the ram apparatus of the dispense system of FIG. 1 in an extended and retracted configuration, respectively.
Figure 3B:
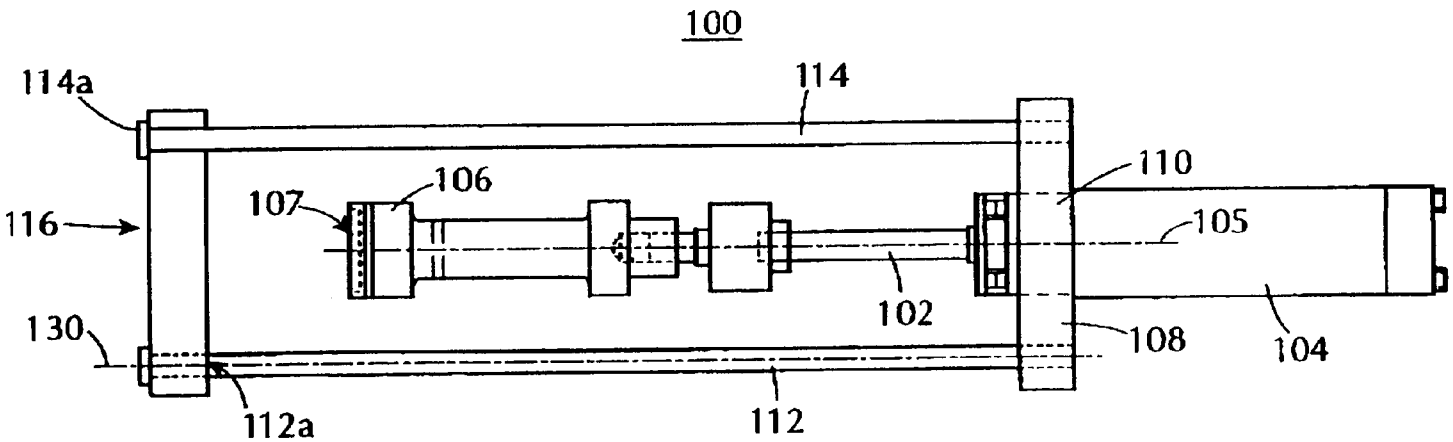

With additional reference to FIGS. 3*a–b*, dispense system 10 incorporates a ram apparatus 100 having an elongate piston rod 102 extendable and retractable with respect to a main cylinder 104 along a piston axis 105 in the directions of arrows A and B. Piston rod 102 includes a piston 106 supporting a piston seal 107 on the free end thereof for compressing a container 14 loaded in dispense system 10. Piston rod is shown incorporating an alignment coupling 109 operable on cylindrical piston 106. Piston seal 107 is desirably a circular disk member having a raised annular rim and is desirably fabricated of an adhesive-resistant material such as polytetrafluoroethylene (PTFE), TEFLON®, DELRIN®, or nylon. Main cylinder 104 is mounted to a planar base plate 108 defining a main aperture 110 therethrough for accommodating piston rod 102. Base plate 108 further supports a first and second elongate guide rod 112 and 114, respectively, extending parallel to and transversely spaced from piston axis 105. Guide rods 112 and 114 support a transverse locking bar 116 at the free ends 112*a* and 114*a*, respectively, thereof.

Figure 4:
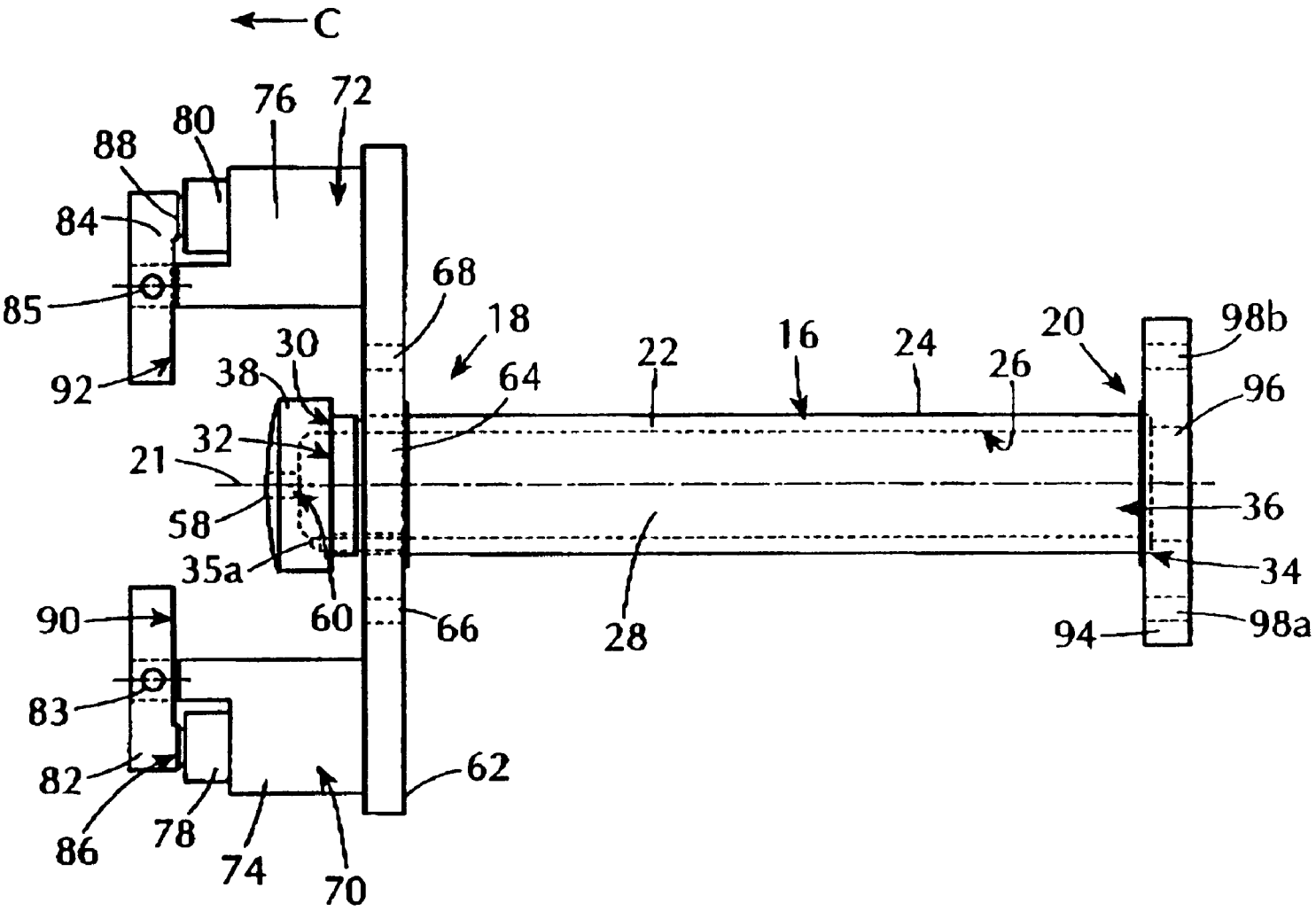
FIG. 4 depicts the dispense cylinder, closure cap, and sealing piston assembly of the dispense system of FIG. 1.
Figure 5:
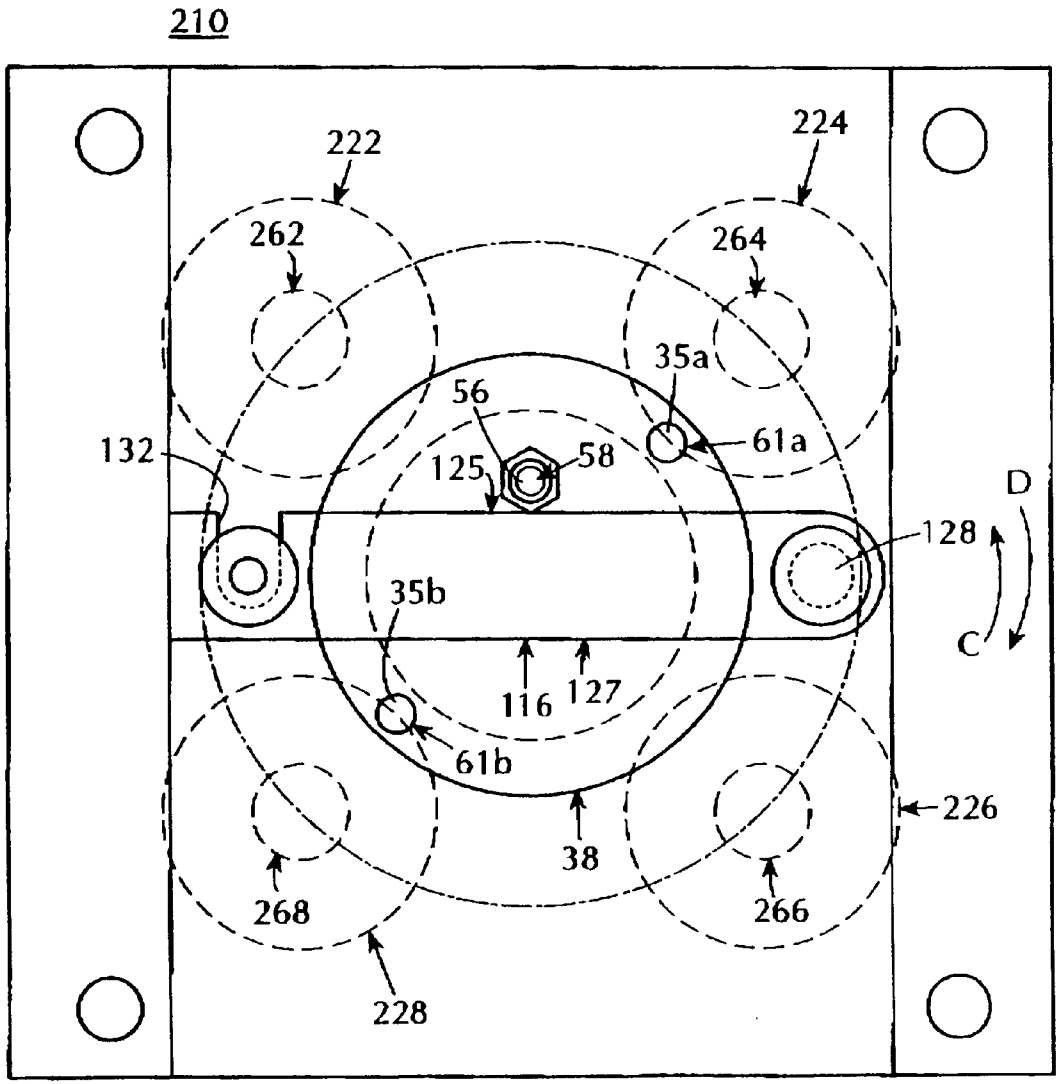
FIG. 5 is a top elevational schematic showing the locking mechanisms of the dispense system of the present invention.

Referring now to FIGS. 3, 4 and 5, locking bar 116 includes a first end 118, an opposed second end 120 and a locking bar body 122 extending therebetween. Locking bar 116 further includes a locking edge 124 and an opposed free edge 126 framing a first transverse major surface 125 and an opposed second transverse major surface 127. First end 118 of locking bar 116 defines an elongate cylindrical passageway extending between locking edge 124 and free edge 126 for accommodating a pivot shaft 128 therethrough. It is contemplated by the present invention that pivot shaft 128 may take the form of a threaded fastener receivably supported by free end 112*a* of guide rod 112. It is also contemplated that pivot shaft 128 may be provided by circumferentially-reduced portion of guide rod 112 itself. Regardless of the form selected, locking bar 116 is desirably pivotable about the longitudinal axis 130 of guide rod 112. Second end 120 of locking bar 116 includes an elongate locking channel 132 opening on first major surface 125 and communicating between locking edge 124 and free edge 126. Locking bar 116 is therefore pivotable about longitudinal axis 125 of guide rod 112 from a closed position whereby guide rod 114, or another pivot member extending longitudinally from guide rod 114, is received within locking channel 132, to an open position whereby locking bar 116 is rotated clear of guide rod 114.

Figure 2:
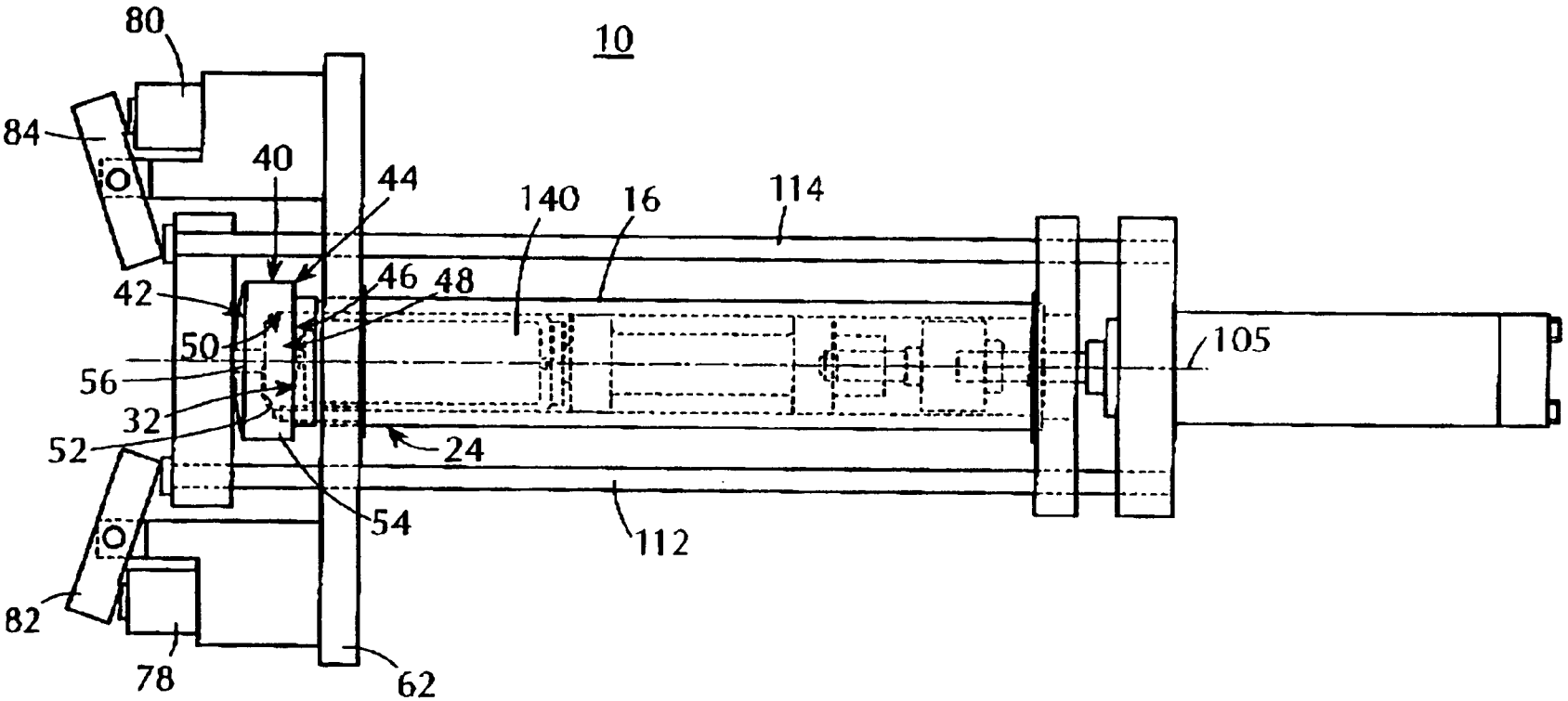
FIG. 2 is a schematic representation of the dispense system of FIG. 1 after the sealing piston assembly has been energized.

As shown in FIGS. 1, 2, and 4, dispense system 10 also includes a primary elongate dispense cylinder 16 having a dispense end 18, an actuation end 20 and an elongate cylindrical wall 22 extending therebetween along a longitudinal axis 21, as shown in FIGS. 1 and 4. Cylindrical wall 22 includes an exterior cylindrical surface 24 and an interior cylindrical surface 26 defining an interior cavity 28. Cylindrical wall 22 terminates at dispense end 18 at first annular rim 30 which further defines a dispense opening 32 for dispense cylinder 16. Annular rim 30 desirably provides a planar rim surface extending transversely to the longitudinal axis 21 of dispense cylinder 16. Similarly, cylindrical wall 22 terminates at actuation end 20 at a second annular rim 34 which further defines a piston opening 36. Annular rim 30 supports first and second positioning pins 35*a* and 35*b*, shown in FIG. 5, extending orthogonally thereto, and will be discussed further hereinbelow.

Dispense system 10 further provides a closure cap 38 for placement in overlying registry with dispense opening 32 of dispense cylinder 16. Closure cap 38 includes a first end 40 providing an arcuate first major surface 42 and an opposed second end 44 defining an annular closure cap rim 46. Closure cap rim 46 is desirably a planar surface extending transversely to longitudinal axis 21 of dispense cylinder 16 when closure cap 38 is positioned in overlying registry with dispense opening 32. Closure cap rim 46 further defines a chubb pack receiving opening 48 being both coaxially-aligned, and coextensive, with dispense opening 32 of dispense cylinder 16. An elongate cylindrical internal wall 50 extends from closure cap rim 46 to a transverse cavity endwall 52 perimetrically bounded thereby. Internal wall 50 and endwall 52 define a closure cap cavity 54 communicating with chubb pack receiving opening 48. Internal wall 50 is desirably formed to be both coaxial and coextensive with interior cylindrical surface 26 of dispense cylinder 16.

Closure cap 38 further defines an elongate fluid dispense passageway 56 communicating between a dispense port 58 defines by first major surface 42 and a burst port 60 defined by cavity endwall 52. Desirably, dispense port 58 and fluid passageway 56 are formed to be transversely spaced from longitudinal axis 21 midway towards internal wall 50 and clear of locking bar 116, as best seen in FIG. 5 for an alternate embodiment of dispense system 10. Locking bar 116 and guide rods 112 and 114 provide a cap blocking assembly against which closure cap 38 is pressed by dispense cylinder 16 when the sealing piston assembly is energized, as explained hereinbelow. This cap blocking assembly is common to all embodiments of the present invention. Dispense port 58 thereby communicates with interior cavity 28 of dispense cylinder 16. It is contemplated by the present invention that dispense port 58 accommodates one end of a dispense conduit, not shown, in fluid communication with a dispense nozzle, not shown, for selectively dispensing fluid 12 from a chubb pack loaded in dispense system 10 to a work surface requiring an adhesive or sealant dispensed thereon.

Closure cap rim 46 further defines first and second alignment bores 61*a* and 61*b* for receiving positioning pins 35*a* and 35*b* extending from annular rim 30. Closure cap 38 is properly aligned over dispense cylinder 16 by inserting positioning pins into alignment bores 61*a* and 61*b*, respectively. Properly aligned, annular rim 30 and closure cap rim 46 abut in coaxial engagement whereby interior cylindrical surface 26 of dispense cylinder 16 extends in flush annular alignment with internal wall 50 of closure cap 38. Closure cap rim 46 is urged into, and maintained in, fluid-tight abutting engagement with annular rim 30 by an exteriorly-mounted sealing-piston assembly, as will be described further herein below. Dispense system 10 thereby defines a container well 140 formed by the portion of closure cap cavity 54 and interior cavity 28 of dispense cylinder 16 remaining between piston seal 107 and burst port 60. The volume of container well 140 varies according to the position of piston seal 107 within interior cavity 28, or closure cap cavity 54, as piston rod 102 extends or retracts in the direction of arrows A and B, respectively.

Referring again to FIGS. 1 and 4, a planar sealing mechanism support plate 62 is affixed to exterior cylindrical surface 24 of dispense cylinder 16, desirably towards dispense end 18. Support plate 62 includes a main aperture 64 therethrough for accommodating exterior cylindrical surface 24. Sealing mechanism support-plate 62 further includes first and second guide rod accommodating passageways 66 and 68 therethrough to provide for sliding movement of support plate 62, and dispense cylinder 16, along first and second guide rods 112 and 114. Additionally, a planar guide plate 94 is affixed to exterior cylindrical surface 24 of dispense cylinder 16 at actuation end 20. Guide plate 94 includes a main aperture 96 which communicates with cylinder cavity 28 and accommodates piston rod 102 extending therethrough. Guide plate 94 further includes first and second guide rod passageways 98*a* and 98*b* extending therethrough for accommodating guide rods 112 and 114. Dispense cylinder 16 is slidable along guide rods 112 and 114 at passageways 66, 68 and 98*a* and 98*b* of plates 62 and 92, respectively.

Sealing mechanism support plate 62 supports thereon a first and second sealing piston 70 and 72. Sealing pistons 70 and 72 include a main sealing piston cylinder 74 and 76 accommodating an extendable and retractable sealing piston rod 78 and 80 and a pivotable locking arm 82 and 84, respectively. Each of locking levers 82 and 84 includes an actuation end 86 and 88 urged by piston rod 78 and 80 and a locking end 90 and 92 for engaging guide rod ends 112*a* and 114*a*, respectively. Locking levers 82 and 84 are pivotally connected at their respective midpoints to a fulcrum arm 83 and 85 extending from main sealing piston cylinder 74 and 76. As piston rods 78 and 80 extend outwardly in the direction of arrow E against actuation ends 86 and 88, locking levers 82 and 84 rotate about fulcrums arms 83 and 85 to engage guide rod ends 112*a* and 114*a*.

Having described its component parts, operation of dispense system 10 will now be described with reference to FIGS. 1–5. Having retracted sealing piston rods 78 and 80 in the direction of arrow F, locking levers 82 and 84 respectively pivot about fulcrum arms 83 and 85 in the unlocking direction of arrow H so as to lower dispense cylinder 16 along guide rods 112 and 114 in the direction of arrow B. The operator may thus swing locking bar 116 in the direction of arrow C about guide rod 112 until clear of closure cap 38. Closure cap 38 is removed from annular rim 30 of dispense cylinder 16. Piston rod 102 and piston seal 107 are desirably retracted-in the direction of arrow B so that a chubb pack bag 15 may be inserted through dispense opening 32 so as to rest on piston seal 107 below annular rim 30. The viscosity of fluid 12 permits chubb pack bag 15 to conform to piston seal 107 and interior cylinder wall 26. It is not necessary for the operator to puncture or otherwise open chubb pack bag 15 prior to loading within dispense cylinder 16. The operator then replaces closure cap 38 in registry over annular rim 30 of dispense cylinder 16. Locking bar 116 is then swung in the direction of arrow D back over major surface 42 of closure cap 38 so that guide rod 114 is received within locking channel 132.

The operator then energizes sealing pistons 70 and 72 so as to extend sealing piston rods 78 and 80 in the direction of arrow E and thereby rotate locking arms 82 and 84 in the locking direction of arrow G, forcing locking ends 90 and 92 against rod ends 112*a* and 114*a*. The net effect of locking levers acting against guide rods 112 and 114 is to pull dispense cylinder 16 in the direction of arrow A until closure cap 38 is forced tightly against locking bar 116. At this point, actuator end 20 of dispense cylinder 16 is suspended above base plate 108. As the sealing force is transferred by annular rim 30 of cylinder wall 22 against closure cap 38, sealing pistons 70 and 72 provide the sealing force holding closure cap 38 against dispense cylinder 16. The operator is therefore relieved of any duty to manually torque or tighten a locking member in order to sealingly force closure cap 38 against dispense cylinder 16 prior to dispensing.

The operator then actuates piston rod 102 to extend in the direction of arrow A toward closure cap 38. As piston rod 102 extends, chubb pack bag 15 will further conform to the internal surfaces presented and the internal pressure generated within container well 140 will likewise increase as chubb pack bag 15 is compressed between piston seal 107 and cavity endwall 52 of cap 38. Chubb pack bag 15 now begins to take on an additional role as a sealing gasket to prevent fluid 12 from traveling between interior cylindrical wall 26 and piston seal 107 or between the interface at closure cap rim 46 and annular rim 30. Once the internal pressure reaches a value greater than the burst pressure of the chubb pack bag 15, that portion of chubb pack bag 15 bounded by the burst port 60 of closure cap 38 ruptures and the contained fluid 12 will be forced through fluid dispense passageway 56 and dispense port 58. At such high internal fluid pressure, chubb pack bag 15 is additionally forced against internal cylindrical wall 26 of dispense cylinder 16 and the frictional force generated therebetween as bag 15 is collapsed assists in further forcing or carrying dispense cylinder 16 against closure cap 38 at the interface of closure cap rim 46 and annular rim 30. Because the actuation end 20 of dispense cylinder 10 is freely supported, so as to be in neither tension nor compression, the sealing force between closure cap 38 and dispense cylinder 16 is augmented by the internal pressure generated at chubb pack bag 15 against cylindrical wall 22.

Throughout the extension of piston rod 102 through dispense cylinder 16, the internal pressure generated on fluid 12 forces chubb pack bag 15 against all the internal surfaces defining container well 140 and thereby continually seals the interfaces at piston seal 107 and at annular rim 30. Piston rod 102 is able to force piston seal fully through container well 140 until chubb pack bag 15 is fully compressed against cavity endwall 52 whereby fluid 12 has been fully dispensed therefrom. Thus, dispense system 10 dispenses the fluid 12 of chubb pack bag 15 in a single stroke and prevents or minimizes the exposure of any intimate parts to fluid 12. Dispense system 10 therefore obviates the need for the costly and time-consuming maintenance and repair as required for reciprocating dispense systems.

After chubb pack bag 15 has been fully compressed, the operator retracts piston rod 102 so as to relieve any pressure remaining within closure cap cavity 54. The operator then de-energizes sealing pistons 70 and 72 so as to retract sealing piston rods 78 and 80. As described hereinabove, the operator may then rotate locking bar 116 clear of closure cap 38 and thereafter remove closure cap 38. The operator would then, if necessary, extend piston rod in the direction of arrow A until piston seal 107 extends through dispense opening 32 of dispense cylinder 16 allowing the operator to remove the collapsed chubb pack bag 15 therefrom. Little or no clean-up is required before loading a subsequent chubb pack bag 15 and repeating the dispensing operation.

It is further contemplated that dispense system 10 may incorporate controlling circuitry requiring first that locking bar 116 is properly positioned prior to energizing sealing pistons 70 and 72. Such circuitry would also ensure that sealing piston rods 78 and 80 are properly extended prior to enabling the extension of piston rod 102. Similarly, the controlling circuitry would prevent the retraction of sealing piston rods 78 and 80 until piston rod 102 has been retracted so as to maintain the integrity of the seal provided by chubb pack bag 15 at the interface of annular rim 30 and closure cap rim 46.

Figure 6:
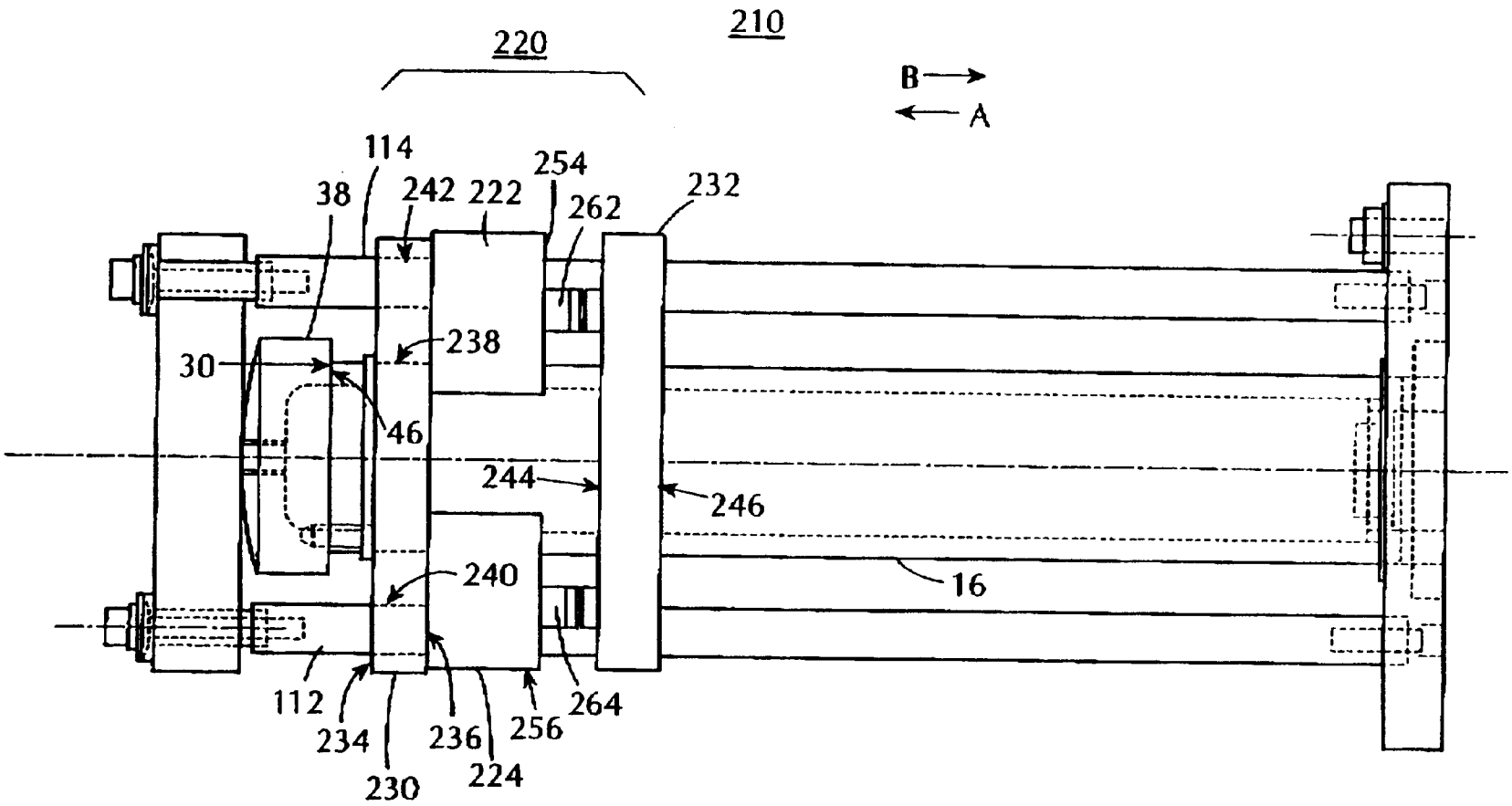
FIG. 6 is a side elevational view of an alternate embodiment of the dispense system of the present invention prior to energizing the sealing piston assembly.
Figure 7:
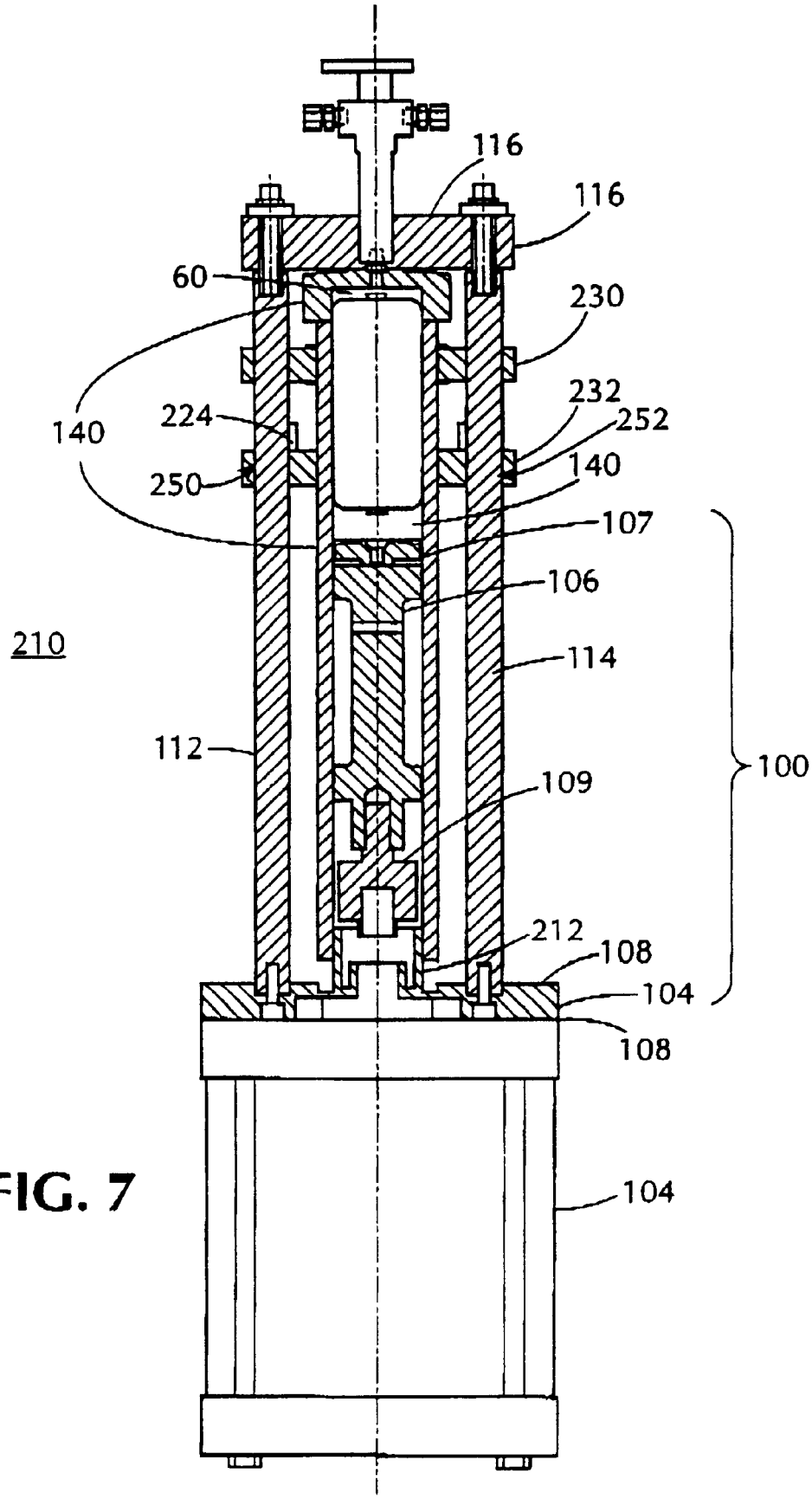
FIG. 7 is a sectional view of the dispense system of FIG. 6 after the sealing piston assembly has been energized.

FIGS. 5–7 depict an alternate embodiment, fluid dispense system 210, of the present invention. Dispense system 210 includes many of the same components as dispense system 10, which are denoted by the same reference numbers. Dispense system 210 desirably utilizes the same ram apparatus 100, dispense cylinder 16, and closure cap 38 of dispense system 10. Dispense system 210 replaces the sealing pistons 70 and 72 and locking levers 82 and 84 of dispense system 10 with an alternate sealing piston assembly 220. Additionally, guide plate 94 of dispense system 10 is also replaced by an internal bushing 212 mounted to base plate 108 and slidably engaging interior cylindrical wall 20 at actuation end 20.

Sealing piston assembly 220 provides a simple but effective means for locking dispense cylinder 16 against closure cap 38 prior to pressurizing fluid container 14. Sealing piston assembly 220 includes four sealing pistons 222, 224, 226, and 228 operable between a first planar plate 230 mounted to exterior cylindrical surface 24 of dispense cylinder 16 and a second planar plate 232 mounted to guide rods 112 and 114. First plate 230 includes opposed major surfaces 234 and 236 and defines a centrally located cylinder passageway 238 and first and second guide rod passageways 240 and 242 communicating therebetween. Second plate 232 includes opposed major surfaces 244 and 246 and defmes a centrally located cylinder passageway 248 and first and second guide rod passageways 250 and 252 communicating therebetween.

Sealing piston assembly 220 further includes sealing pistons 222, 224,226, and 228 include main piston cylinders 254, 256, 258, and 260 supporting linearly-extendable sealing piston rods 262, 264, 266, and 268, respectively. Main piston cylinders 254, 256, 258, and 260 are mounted on major surface 236 of first plate 230 in facing opposition to major surface 244 of second plate 232. Sealing piston rods 262, 264, 266, and 268 are extendable against major surface 244 of second plate 232. As first plate 230 is fixed to dispense cylinder 16 and slidable with respect to guide rods 112 and 114, and as second plate 232 is slidable with respect to dispense cylinder 16 and fixed to guide rods 112 and 114, the extension of the sealing piston rods in the direction of arrow B against second plate 232 carries first plate 230, dispense cylinder 16, and closure cap 38 in the direction of arrow A against locking bar 116. Sealing pistons 222, 224, 226, and 228 therefore provide a sealing force pinning annular rim 30 of dispense cylinder 16 against closure cap rim 46 of closure cap 38 so as to seal container well 140.

The steps for operation of dispense system 210 are essentially the same as those for dispense system 10. Additionally, the features and contemplated additions for dispense system 10 are also provided by or contemplated for dispense system 210. Having retracted sealing piston rods 262, 264, 266, and 268 into main piston cylinders 254, 256, 258, and 260, so as to lower dispense cylinder 16 along guide rods 112 and 114 in the direction of arrow B. The operator may thus swing locking bar 116 in the direction of arrow C about guide rod 112 until clear of closure cap 38. Closure cap 38 is removed from annular rim 30 of dispense cylinder 16. Piston rod 102 and piston seal 107 are retracted in the direction of arrow B so that a chubb pack bag 15 may be inserted through dispense opening 32 and come to rest on piston seal 107 fully below annular rim 30. The viscosity of fluid 12 permits chubb pack bag 15 to conform to piston seal 107 and interior cylinder wall 26. It is not necessary for the operator to puncture or otherwise open chubb pack bag 15 prior to loading within dispense cylinder 16. The operator then replaces closure cap 38 in registry over annular rim 30 of dispense cylinder 16. Locking bar 116 is then swung in the direction of arrow D back over major surface 42 of closure cap 38 so that guide rod 114 is received within locking channel 132.

The operator then energizes sealing pistons 222, 224, 226, and 228 so as to extend sealing piston rods 262, 264, 266, and 268 in the direction of arrow B and thereby push dispense cylinder 16 against closure cap 38. Closure cap 38 is also forced tightly against locking bar 116. At this point, actuator end 20 of dispense cylinder 16 is suspended above base plate 108. As the sealing force is transferred by annular rim 30 of cylinder wall 22 against closure cap 38, sealing pistons 222, 224, 226, and 228 provide the sealing force holding closure cap 38 against dispense cylinder 16. The operator is again relieved of any duty to manually torque or tighten a locking member in order to sealingly force closure cap 38 against dispense cylinder 16 prior to dispensing.

The operator then actuates piston rod 102 to extend in the direction of arrow A toward closure cap 38. As piston rod 102 extends, chubb pack bag 15 will further conform to the internal surfaces presented and the internal pressure generated within container well 140 will likewise increase as chubb pack bag 15 is compressed between piston seal 107 and cavity endwall 52 of cap 38. Chubb pack bag 15 now begins to take on an additional role as a sealing gasket to prevent fluid 12 from traveling between interior cylindrical wall 26 and piston seal 107 or between the interface at closure cap rim 46 and annular rim 30. Once the internal pressure reaches a value greater than the burst pressure of the chubb pack bag 15, that portion of chubb pack bag 15 bounded by the burst port 60 of closure cap 38 ruptures and the contained fluid 12 will be forced through fluid dispense passageway 56 and dispense port 58. At such high internal fluid pressure, chubb pack bag 15 is additionally forced against internal cylindrical wall 26 of dispense cylinder 16 and the frictional force generated therebetween as the bag 15 is collapsed assists in further forcing dispense cylinder 16 against closure cap 38 at the interface of closure cap rim 46 and annular rim 30. Thus the sealing force between closure cap 38 and dispense cylinder 16 is again augmented by the internal pressure generated at chubb pack bag 15 with cylindrical wall 22.

Throughout the extension of piston rod 102 through dispense cylinder 16, the internal pressure generated on fluid 12 forces chubb pack bag 15 against all the internal surfaces defining container well 140 and thereby continually seals the interfaces at piston seal 107, at annular rim 30, and about the rim of burst port 60. Piston rod 102 is able to force piston seal fully through container well 140 until chubb pack bag 15 is fully compressed against cavity endwall 52 whereby fluid 12 has been fully dispensed therefrom. Thus, dispense system 10 dispenses the fluid 12 of chubb pack bag 15 in a single stroke and prevents or minimizes the exposure of any intimate parts to fluid 12. Dispense system 10 therefore obviates the need for the costly and time-consuming maintenance and repair as required for reciprocating dispense systems.

After chubb pack bag 15 has been fully compressed, the operator retracts piston rod 102 so as to relieve any pressure remaining within closure cap cavity 54. The operator then de-energizes sealing pistons 70 and 72 so as to retract sealing piston rods 78 and 80. As described hereinabove, the operator may then rotate locking bar 116 clear of closure cap 38 and thereafter remove closure cap 38. The operator would then, if necessary, extend piston rod in the direction of arrow A until piston seal 107 extends through dispense opening 32 of dispense cylinder 16 allowing the operator to remove the collapsed chubb pack bag 15 therefrom. Little or no clean-up is required before loading a subsequent chubb pack bag 15 and repeating the dispensing operation.

Figure 8:
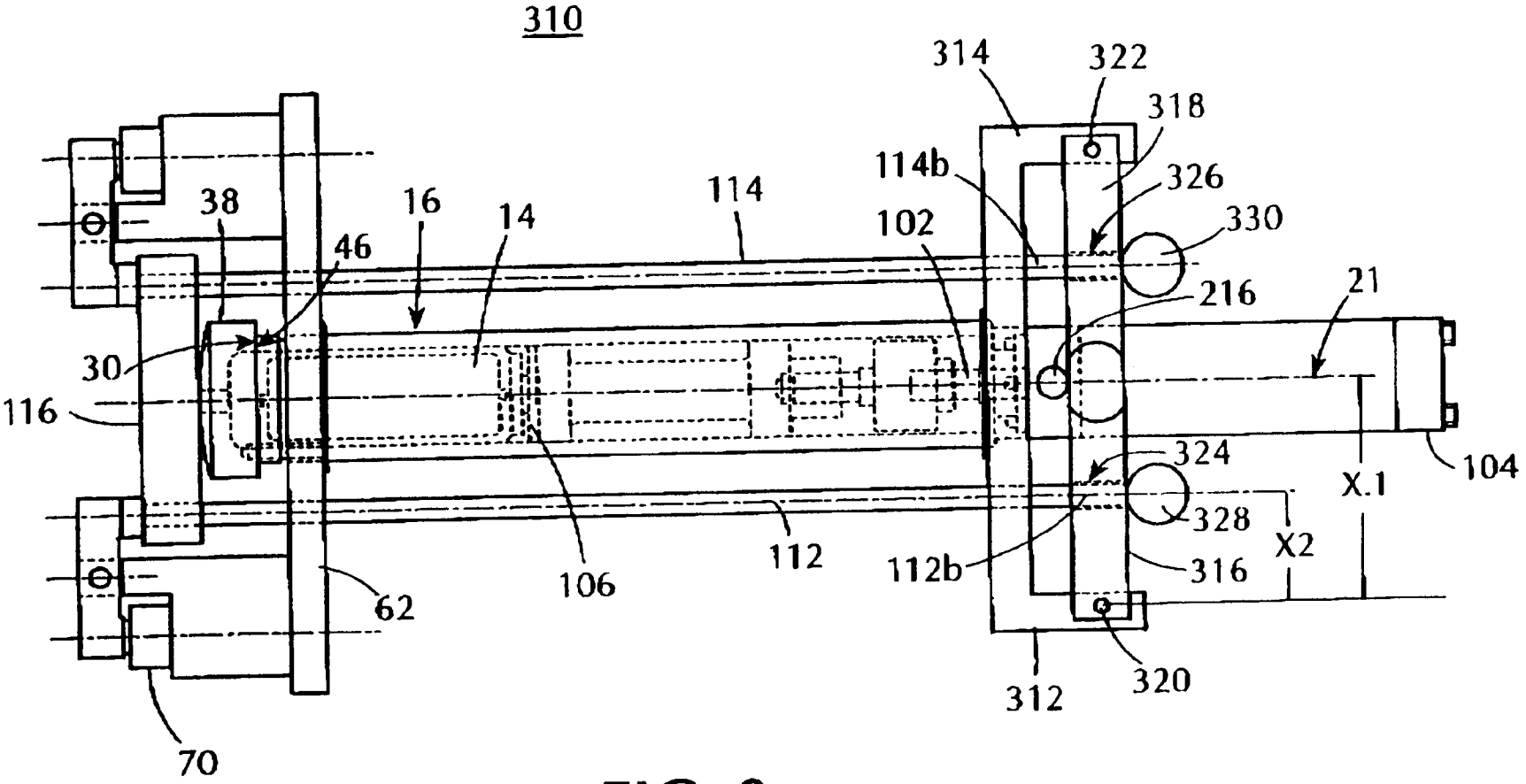
FIG. 8 is a schematic representation of yet another embodiment of the dispense system of the present invention.

With reference to FIG. 8, the present invention also contemplates a modification to dispense system 10 so as to provide additional sealing force for pinning dispense cylinder 16 against closure cap 38. Dispense system 310 includes many of the same components as dispense system 10, which will be noted by the same numbers. Dispense system 310 desirably utilizes the same ram apparatus 100, dispense cylinder 16, closure cap 38, sealing pistons 70 and 72 and locking levers 82 and 84 of dispense system 10. Base plate is removed and guide plate 94 of dispense system 10 is modified to include first and second transversely-spaced cantilever arms 312 and 314 pivotally supporting first and second yokes 316 and 318, at pivot pins 320 and 322, respectively. First and second yokes 316 and 318 each provide a bushing 324 and 326 for slidably accommodating guide rods 112 and 114 therethrough. Main cylinder 104 of ram apparatus 100 includes a trunnion 216 mounted thereon for abutting engagement with yokes 316 and 318 so as to force same against stop members 328 and 330 mounted on ends 112*b* and 114*b* of guide rods 112 and 114.

As seen in FIG. 8, pivot pins 320 and 322 are oppositely transversely spaced a dimension X1 from longitudinal axis 21, and a dimension X2 from stop members 328 and 330. As a result of the leverage obtained from trunnion 216 countering the extension of piston rod 102, additional sealing force is generated for driving dispense cylinder 16 against closure cap 38. The ratio of dimension X1 to X2 determine the resultant sealing force transferred to dispense cylinder 16 due to the extension of piston rod 102 in the direction of arrow A. The higher the ratio of X1 to X2, the higher the additional sealing force at the interface of closure cap rim 46 and annular rim 30. The additional sealing force transmitted to dispense cylinder 16 is thereby proportional to the internal pressure generated at container 14 by the action of piston rod 102 thereagainst.

The steps for operation of dispense system 310 are essentially the same as those for dispense system 10. Additionally, the features and contemplated additions for dispense system 10 are also provided by or contemplated for dispense system 210.

Figure 9:
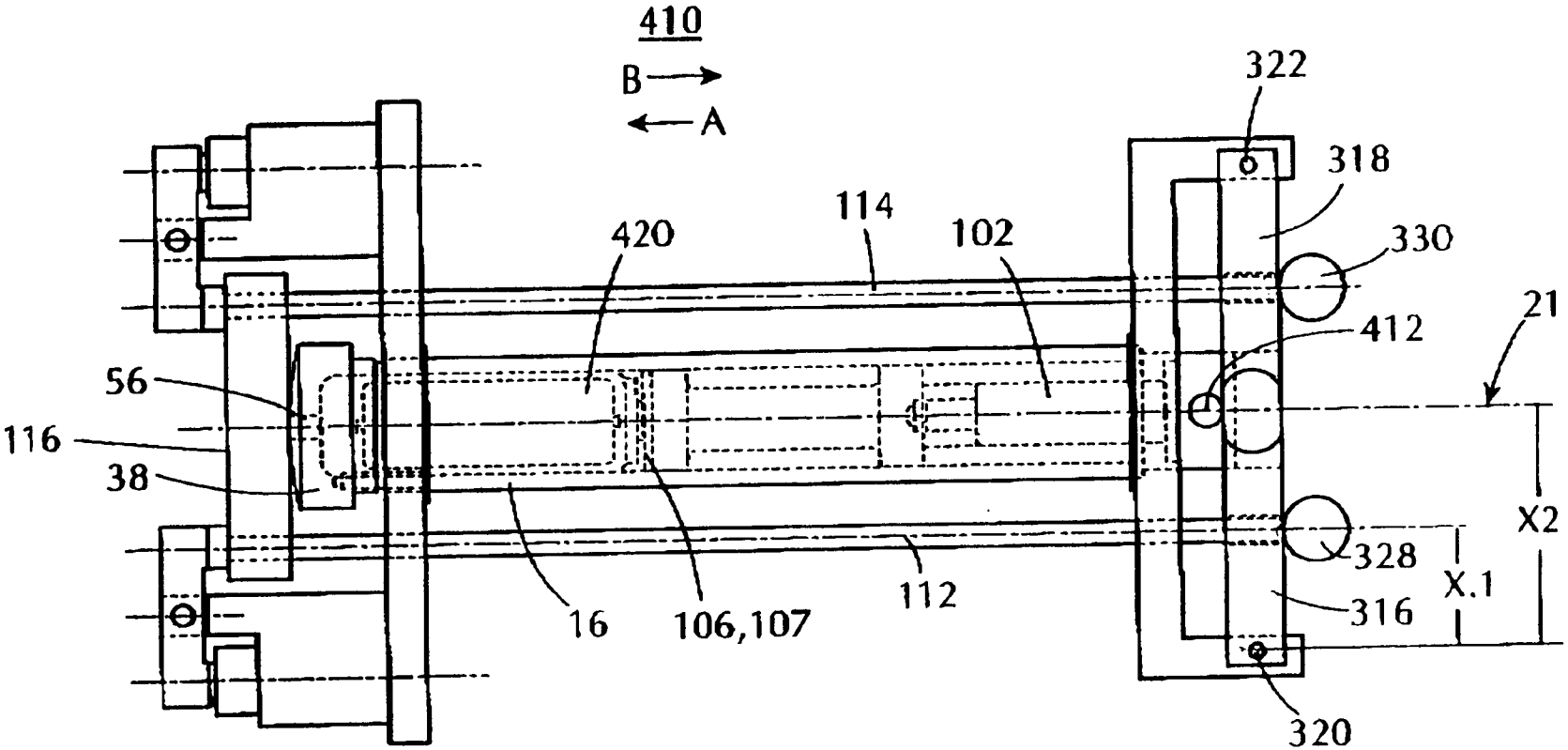
FIG. 9 is a schematic representation of a pressure vessel of the present invention based on a modification of the dispense system of FIG. 8.

The present invention further contemplates applications having a need to counter an internal pressure generated within a cylinder. Referring to FIG. 9, the present invention provides a pressure vessel 410 employing the components of dispense system 310 in which main cylinder 104 is removed and a trunnion 412 is mounted on piston rod 102 for abutting engagement with first and second yokes 316 and 318. For purposes of this description, container well 140 is identified as pressure chamber 420. Pressure chamber 420 communicates through passageway 56 formed in closure cap 38. An internal pressure rise in pressure chamber 420 urges piston rod 102 in the direction of arrow B. Movement of piston rod 102 in the direction of arrow B is countered by guide rods 112 and 114 being acted upon as trunnion 412 engages yokes 316 and 318. As was seen with dispense system 310, yokes 316 and 318 generate a reaction force to actuation end 20 in the direction of arrow A, to thereby increase the sealing force of dispense cylinder 16 against closure cap 38 in direct proportion to the internal pressure in chamber 420. The magnitude of the additional sealing force depends of the distance ratio X1/X2 of longitudinal axis 21 to pivot pins 320,322 and to stop members 328,330, respectively.

Figure 10:
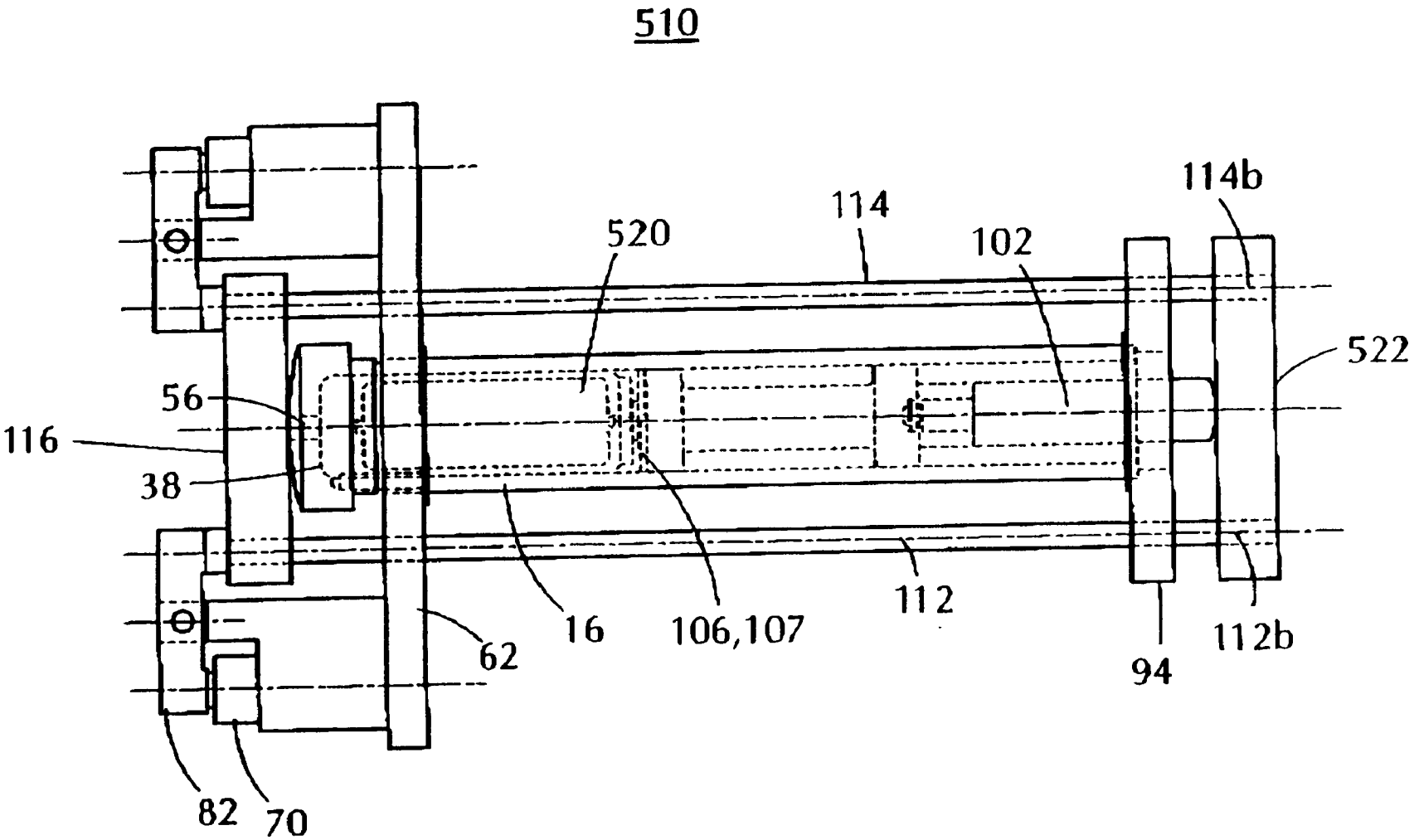
FIG. 10 is a schematic representation of a pressure vessel of the present invention based on a modification of the dispense system of FIG. 1.

FIG. 10 depicts still another pressure vessel 510, based on the design of dispense system 10, for countering a rise in the internal pressure of a pressure chamber 520. Pressure vessel 510 employs many components of dispense system 10 but replaces main cylinder 104 and base plate 108 with a fixed reaction bar 522 fixed to ends 112*b* and 114*b* of guide rods 112 and 114. Piston rod 102 engages reaction bar 522 in response to the internal pressure generated in chamber 520.

A rise in internal pressure in pressure chamber 520 urges piston rod in the direction of arrow B 10 against reaction bar 522. Reaction bar 522 imparts a tension reaction force to guide rods 112 and 114 and across locking bar 116.

From the foregoing description, it can be seen that the present invention provides an easily manufactured collapsible tube dispensing apparatus capable of manually metering out precise amounts of product with minimal waste. The apparatus can be made in its entirety from any suitable rigid material, the most preferred being a thermoplastic material. It will be recognized by those skilled in the art that although certain modifications have been suggested, other changes could be made to the above-described invention without departing from the broad inventive concepts thereof. It is understood, therefore, that the invention is not limited to the particular embodiments shown and disclosed, but is intended to cover any modifications which are within the scope and spirit of the invention as defined by the claims.

What is claimed is:

1. A single stroke fluid dispense system, comprising:

an elongate dispense member having a dispense end defining a dispense end opening and a container well communicating with said dispense end opening for receiving a fluid to be dispensed;

a closure cap supported over said dispense end opening of said dispense member, said closure cap further defining a dispense port at one end of an elongate fluid passageway extending therethrough in fluid communication with said container well for dispensing a fluid from said dispense member;

a compression assembly for forcing the fluid through said fluid passageway of said closure cap; and a sealing piston assembly for maintaining said closure cap in sealing engagement with said dispense member.

2. The dispense system of claim 1, wherein said sealing piston assembly further comprises:

a cap blocking assembly comprising first and second spaced-apart elongate guide rods extending along said dispense member, each said guide rod including a first end adjacent said dispense opening of said dispense member, and an elongate locking bar extendable between said first ends of said guide rods across said closure cap opposite said dispense member;

a first plate affixed to said dispense member;

a plurality of sealing pistons supported by said first plate, each said sealing piston including a sealing piston cylinder and a sealing piston rod extendable and retractable from said sealing piston cylinder; said sealing piston rods being operable against said first and second guide rods to compress said closure cap between said dispense member and said locking bar.

3. The dispense system of claim 2, further comprising a second plate fixed with respect to said first and second guide rods, said second plate defining a centrally-located dispense cylinder passageway therethrough for accommodating said dispense member, said sealing piston rods operable against said second plate to move said dispense member against said closure cap.

4. The dispense system of claim 3, wherein said second plate is affixed to said first guide rod.

5. The dispense system of claim 2, wherein said sealing piston assembly further comprises an elongate locking lever pivotally mounted for each sealing piston rod, each said locking lever including a first end engaging one said sealing piston rod and a second opposite end engaging one of said first and second guide rods, whereby extension of said piston rods against said first ends of said locking levers raises said dispense member against said closure cap.

6. The dispense system of claim 2, wherein said locking bar includes a first end pivotally connected to said first guide rod and a second end defining a transversely-extending notch for receiving said second guide rod.

7. The dispense system of claim 1, wherein said dispense member comprises an elongate hollow dispense cylinder having an actuation end opposite said dispense end, and an internal cylindrical wall defining an elongate cylindrical passageway therethrough.

8. The dispense system of claim 3, further comprising a hollow internal bushing extending into said actuation end of said dispense cylinder and fixed with respect to said first and second guide rods; said internal bushing defining a bushing passageway through which said compression assembly extends.

9. The dispense system of claim 7, wherein said compression assembly further comprises a ram apparatus including a main dispense cylinder supporting an elongate dispense piston rod extendable and retractable from said main dispense cylinder; and an internal piston slidable within said cylindrical passageway of said dispense cylinder, said internal piston supporting a piston seal for slidably sealingly engaging said cylindrical wall of said dispense cylinder;

wherein said dispense piston rod is coupled to said internal piston to extend said internal piston towards said dispense cap upon extension of said dispense piston rod from said main dispense cylinder.

10. The dispense system of claim 9, wherein said piston seal is formed of polytretraflouroethylene.

11. The dispense system of claim 10, further comprising:

a flexible rupturable container including said fluid to be dispensed; and a burst port defined by said dispense port of said closure cap;

wherein said compression assembly maintains fluid integrity between said container and said closure cap about said burst port and wherein said container provides a seal at the interface between said dispense member and said closure cap during dispensement of said fluid to be dispensed through said closure cap.

12. The dispense system of claim 11, wherein said compression assembly forces said container against said internal dispense cylinder wall to further carry said dispense cylinder against said closure cap.

13. The dispense system of claim 12, wherein, during dispensement of said fluid to be dispensed through said closure cap, said ram apparatus maintains fluid integrity between the container and said closure cap about said rupture port and the container seals the interface between said dispense cylinder and said closure cap.

14. The dispense system of claim 1, wherein said dispense member includes a planar annular rim defining said dispense opening and said closure cap includes a planar annular closure cap rim, wherein said planar annular rim of said dispense member abuts against said planar closure cap rim when said sealing piston assembly maintains said closure cap in sealing engagement with said dispense member.

15. The method of claim 14, further comprising the step of maintaining fluid integrity between said container and said closure cap at said burst port throughout dispensement of said fluid to be dispensed from said container.

16. The dispense system of claim 1, wherein said planar annular closure cap rim defines a pair of alignment bores extending transversely thereto and said planar annular rim of said dispense member supports a pair of positioning pins extending transversely therefrom to properly align said closure cap in registry with said dispense opening of said dispense member.

17. The method of claim 16, wherein said thrusting step further comprises augmenting the sealing force between said dispense cylinder and said closure cap by generating fluid pressure within said container well so as to force said container against said internal cylindrical wall to further carry said dispense cylinder against said closure cap.

18. The dispense system of claim 1, wherein said closure cap further defines a closure cap cavity positionable in fluid communication with said container well.

19. A single stroke fluid dispense system for dispensing the contents of a collapsible rupturable plastic container of fluid, comprising:

an elongate hollow dispense cylinder having a dispense end, an actuation end opposite said dispense end, and an internal cylindrical wall defining an elongate cylindrical passage;

a closure cap supported over said dispense end of said dispense cylinder, said closure cap and said internal cylindrical wall defining a container well for receiving the container of fluid, said closure cap further including a rupture port defining one end of a fluid passageway through said closure cap in fluid communication with said container well;

an internal piston mounted for sliding engagement with said internal cylindrical wall and extendable through said container well;

a ram apparatus operable against said internal piston to move said internal piston towards and away from said closure cap; and a sealing piston assembly to carry said dispense cylinder against said closure cap in sealing registry over said dispense end opening of said dispense member and for freely supporting said working end of said dispense cylinder with respect to said ram apparatus;

whereby said ram apparatus forces the container against said internal dispense cylinder wall to further carry said dispense cylinder against said closure cap.

20. A method of dispensing a fluid, comprising the steps of:

providing a fluid to be dispensed in a flexible rupturable container;

providing an elongate dispenser housing including a dispense end defining a dispense opening and an internal cylindrical wall defining a dispenser well communicating with said dispense opening and further including an actuation end opposite said dispense end;

positioning a closure cap defining a burst port defining one end of an elongate fluid passageway through said closure cap over said dispense opening;

thrusting said container against said closure cap with sufficient force to rupture said container at said burst port to express the fluid to be dispensed through said fluid passageway of said cap and to provide a seal with said container at said closure cap; and freely supporting said actuation end of said dispense housing during said forcing step.

* * * * *